US008967949B2

(12) United States Patent
Gamissans Bou

(10) Patent No.: US 8,967,949 B2
(45) Date of Patent: Mar. 3, 2015

(54) SOUND-PROOFED HELICOCENTRIFUGAL FAN

(75) Inventor: Marius Gamissans Bou, Vic (ES)

(73) Assignee: Soler & Palau Research, S.L.U., Parets del Vallès (Barcelona) (ES)

( * ) Notice: Subject to any disclaimer, the term of this patent is extended or adjusted under 35 U.S.C. 154(b) by 649 days.

(21) Appl. No.: 13/320,103

(22) PCT Filed: Jul. 19, 2010

(86) PCT No.: PCT/ES2010/000312

§ 371 (c)(1),
(2), (4) Date: Nov. 11, 2011

(87) PCT Pub. No.: WO2011/015680

PCT Pub. Date: Feb. 10, 2011

(65) Prior Publication Data

US 2012/0051889 A1 Mar. 1, 2012

(30) Foreign Application Priority Data

Jul. 29, 2009 (ES) ..... 200901678

(51) Int. Cl.

| | |
|---|---|
| ***F04D 29/66*** | (2006.01) |
| ***F04D 29/64*** | (2006.01) |
| ***F04D 29/52*** | (2006.01) |
| ***F04D 17/06*** | (2006.01) |

(52) U.S. Cl.

CPC ..... *F04D 29/526* (2013.01); *F04D 17/06* (2013.01); *F04D 29/664* (2013.01); *Y10S 403/09* (2013.01); *Y10S 403/14* (2013.01)

USPC ..... 415/119; 415/213.1; 415/214.1; 415/220; 415/223; 181/200; 181/205; 181/224; 181/225; 285/236; 285/369; 285/418; 403/301; 403/305; 403/341; 403/DIG. 9; 403/DIG. 14

(58) Field of Classification Search

USPC ..... 415/119, 213.1, 214.1, 220, 222, 223; 181/225, 200, 205, 224; 285/236, 369, 285/417, 418; 403/300, 301, 305, 341, 403/DIG. 9, DIG. 14

See application file for complete search history.

(56) References Cited

U.S. PATENT DOCUMENTS

| | | | | |
|---|---|---|---|---|
| 3,229,896 | A * | 1/1966 | Levy | 417/423.8 |
| 3,312,386 | A * | 4/1967 | Hull et al. | 415/218.1 |
| 3,346,174 | A * | 10/1967 | Lievens et al. | 415/119 |
| 3,540,547 | A | 11/1970 | Coward, Jr. | |
| 3,602,333 | A | 8/1971 | Kobayashi et al. | |
| 4,692,091 | A * | 9/1987 | Ritenour | 415/119 |
| 6,457,748 | B1 * | 10/2002 | Webb et al. | 285/369 |
| 2004/0005215 | A1 | 1/2004 | Della Mora | |
| 2008/0056882 | A1 | 3/2008 | Clay et al. | |

FOREIGN PATENT DOCUMENTS

| | | | | |
|---|---|---|---|---|
| DE | 20 2004 020 094 U1 | 3/2005 | | |
| ES | 2 020 637 A6 * | 8/1991 | | F04D 29/44 |
| WO | WO 2008/093496 A1 * | 8/2008 | | F04D 29/66 |

* cited by examiner

*Primary Examiner* — Christopher Verdier
(74) *Attorney, Agent, or Firm* — Lucas & Mercanti, LLP

(57) ABSTRACT

A sound-proofed helicocentrifugal fan includes a helicocentrifugal propeller associated with a motor, housed in a casing formed by a central piece and respective end pieces, which pieces are perforated with holes distributed over the entire surface except for the area around the propeller. A sound-absorbing blanket surrounds the casing, and an outer casing is disposed around the entire assembly.

4 Claims, 7 Drawing Sheets

SOUND-PROOFED HELICOCENTRIFUGAL FAN

This application is a 371 of PCT/ES2010/000312 filed Jul. 19, 2010, which in turn claims the priority of ES P200901678 filed Jul. 29, 2009, the priority of both applications is hereby claimed and both applications are incorporated by reference herein.

SECTOR OF THE ART

The present invention relates to the field of fans with air driving means, proposing a helicocentrifugal tubular fan with structural features giving it an advantageous sound-proofing quality.

STATE OF THE ART

The need for mechanisms and machines to perform their function with a reduced level of sound emission is common in industry, so the use of perforated or grooved panels in combination with sound-absorbing blankets which attenuate the noise generated is known.

This need for sound-proofing is important in the field of air driving by means of fans so as to prevent the noise produced by the fan during its operation from being transmitted outside and through the air circulation channels, which is conventionally resolved by means of using perforated panels and sound-absorbing blankets which are installed in a parallelepiped-shaped casing in which the fan is arranged.

On the other hand, the use of axial tubular extractors or fans which are intercalated in air circulation pipes is known, with the body of the fans or extractors formed by a cylindrical tubular casing housing a blade impeller and the elements for operating same, incorporating at the ends of the casing coupling elements for the attachment to the air circulation pipes.

Said arrangement has the advantage that in order to disassemble the fan, the attachments of the ends of the casing with respect to the coupling pipes must simply be released, whereby the assembly which houses the fan is free to be extracted, maintenance and repair operations thus being extremely simple. An embodiment is further known in which the coupling elements of the ends of the casing which houses the fan have L-shaped formations which determine a fixing base for anchoring the fan in the installation site.

The axial fans used for driving air through pipes are conventionally helical or axial type, i.e., they drive the air in the direction of the axis of the blade impeller, the features of these fans being limited by the maximum diameter of the impeller and the pipes through which the air is driven.

Solutions have been developed to improve the air driving features, such as the solution of patent ES 9000539, which uses a helicocentrifugal type fan, arranging a helicocentrifugal propeller within cylindrical tubular body to which respective parts are coupled at the ends, this entire assembly being surrounded with an outer casing on which the couplings of the air circulation pipes are arranged.

With said arrangement, however, the sound-proofing of the noise which the fan produces in its operation is not achieved, such that the noise is transmitted through the casing which houses the fan and through the air circulation ducts; conventionally resorting to the incorporation of silencers at the entrance and the exit of the fan to prevent that effect, whereby only partial sound-proofing is achieved since the noise continues to be transmitted through the casing which houses the fan.

OBJECT OF THE INVENTION

According to the present invention an advantageous arrangement of a helicocentrifugal fan is presented, whereby the noise of the fan is effectively attenuated, preventing the propagation of said noise both through the air circulation ducts as well as through the casing which houses the fan.

The fan object of the invention comprises a perforated cylindrical piece inside which a motor is housed, to which motor a helicocentrifugal propeller protruding at one end is coupled, two other perforated tubular pieces being connected with the ends of said cylindrical piece, which pieces determine at one end a mouth corresponding with the piece which houses the motor of the propeller and at the other end a mouth corresponding with pieces to which the air conduction pipes to which the fan is to be coupled are coupled.

Between the central piece which houses the motor of the propeller and the two pieces which are coupled at the ends thereof, a casing which is perforated in its entirety except in the area surrounding the propeller is determined, the holes therein being defined according to a singular distribution which favors noise attenuation.

An outer casing is arranged covering the aforementioned assembly, which is made up of two complementary halves coupled to one another, such that between said outer casing and the perforated casing in which the propeller and the motor are housed a chamber is arranged, in which chamber a blanket made of a sound-absorbing material is arranged.

Pieces are coupled on the end pieces of the perforated casing which houses the helicocentrifugal propeller and the drive motor, which pieces form flexible strips in the attachment therewith which are made of an elastomeric material, acting as flanges for fastening the aforementioned end pieces of the perforated casing, said pieces determining a cylindrical formation made of an elastomeric material for coupling the pipes to which the fan is to be attached.

An assembly is thus obtained in which the noise produced by the fan in its operation is attenuated by means of the perforated casing and the sound-absorbing blanket arranged on it, which absorb the operating noise and vibrations, preventing them from being transmitted to the exterior and to the air circulation ducts.

A terminal box is arranged in one of the halves of the outer casing for connecting the electrical supply of the drive motor of the helicocentrifugal propeller, said terminal box being incorporated in a rotating arrangement which allows orienting the passage of connection cables in the appropriate direction. In addition, the entire fan assembly is susceptible to being arranged in any angular position with respect to the pieces on which they are secured, allowing that the terminal box to be situated in the most appropriate position according to the available space in the fan installation site.

A fan is thus obtained with very advantageous structural and functional features, acquiring its own identity and preferred character for the application function for which it is intended because it effectively and practically solves the sound-proofing problems which conventional fans of the same type have.

DETAILED DESCRIPTION OF THE INVENTION

Figure 1:
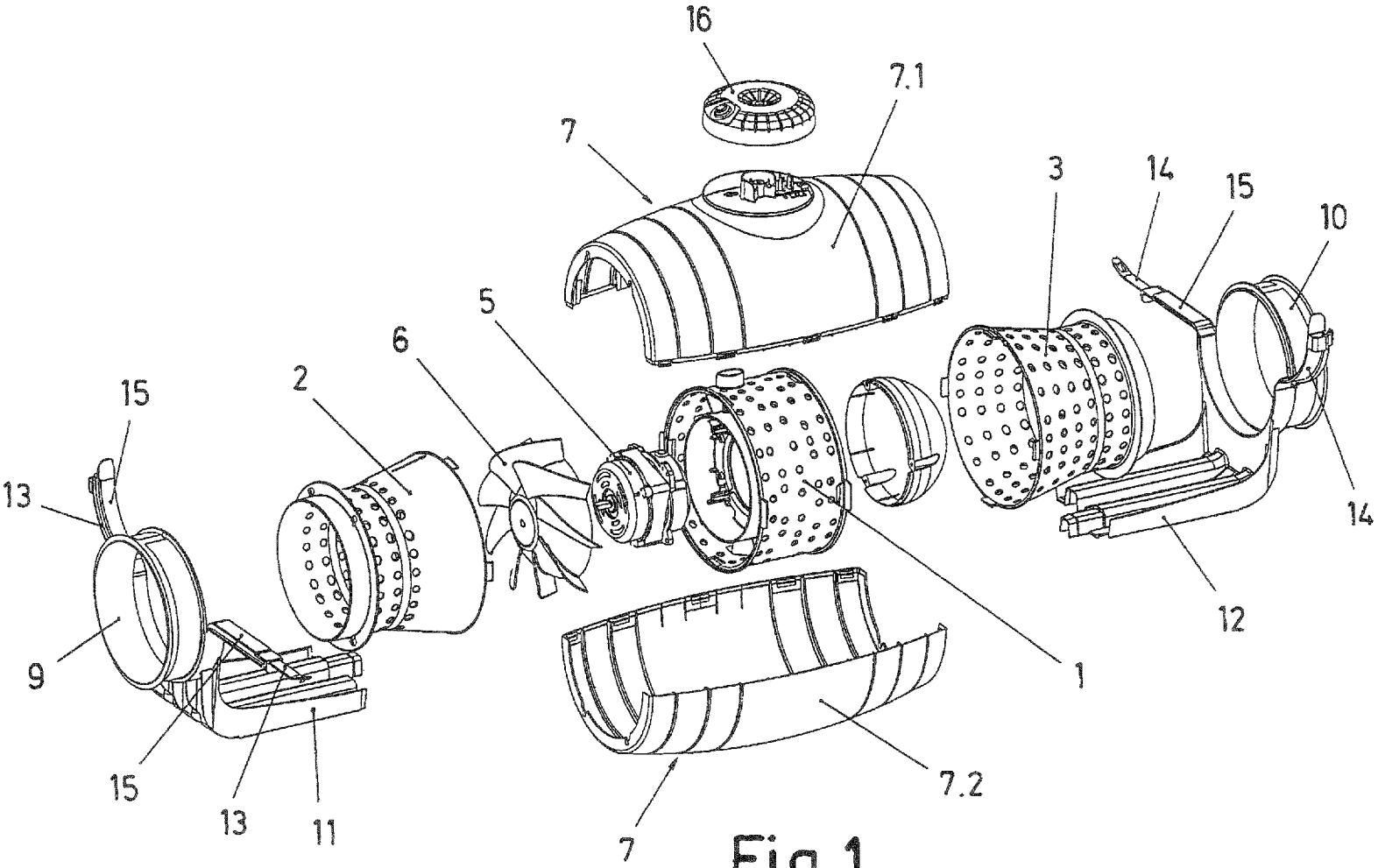
FIG. 1 shows an exploded perspective view of the proposed fan according to one embodiment without the sound-absorbing blanket.
Figure 2:
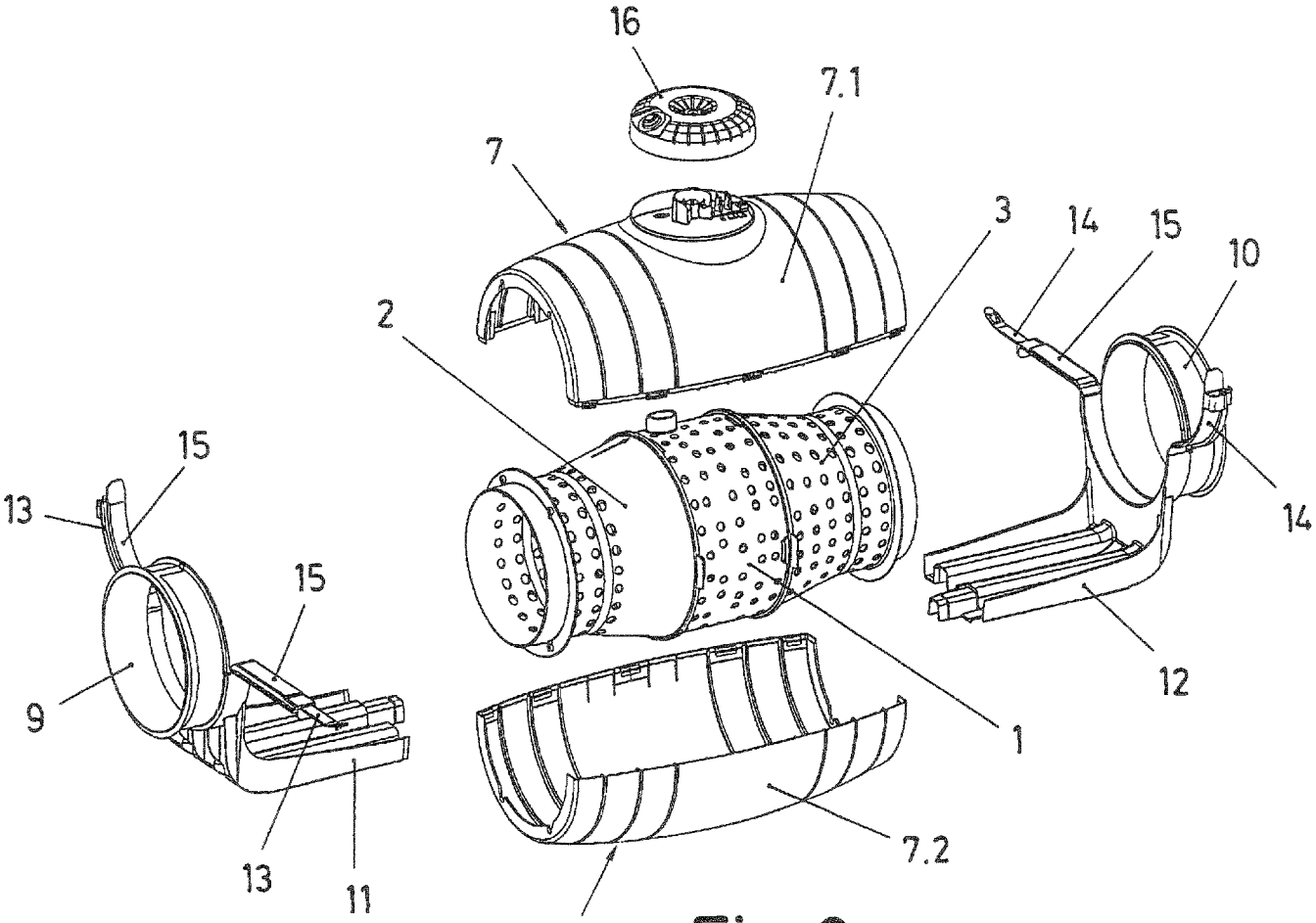
FIG. 2 shows a view of the assembly of the previous figure with the pieces of the perforated casing attached to one another.
Figure 3:
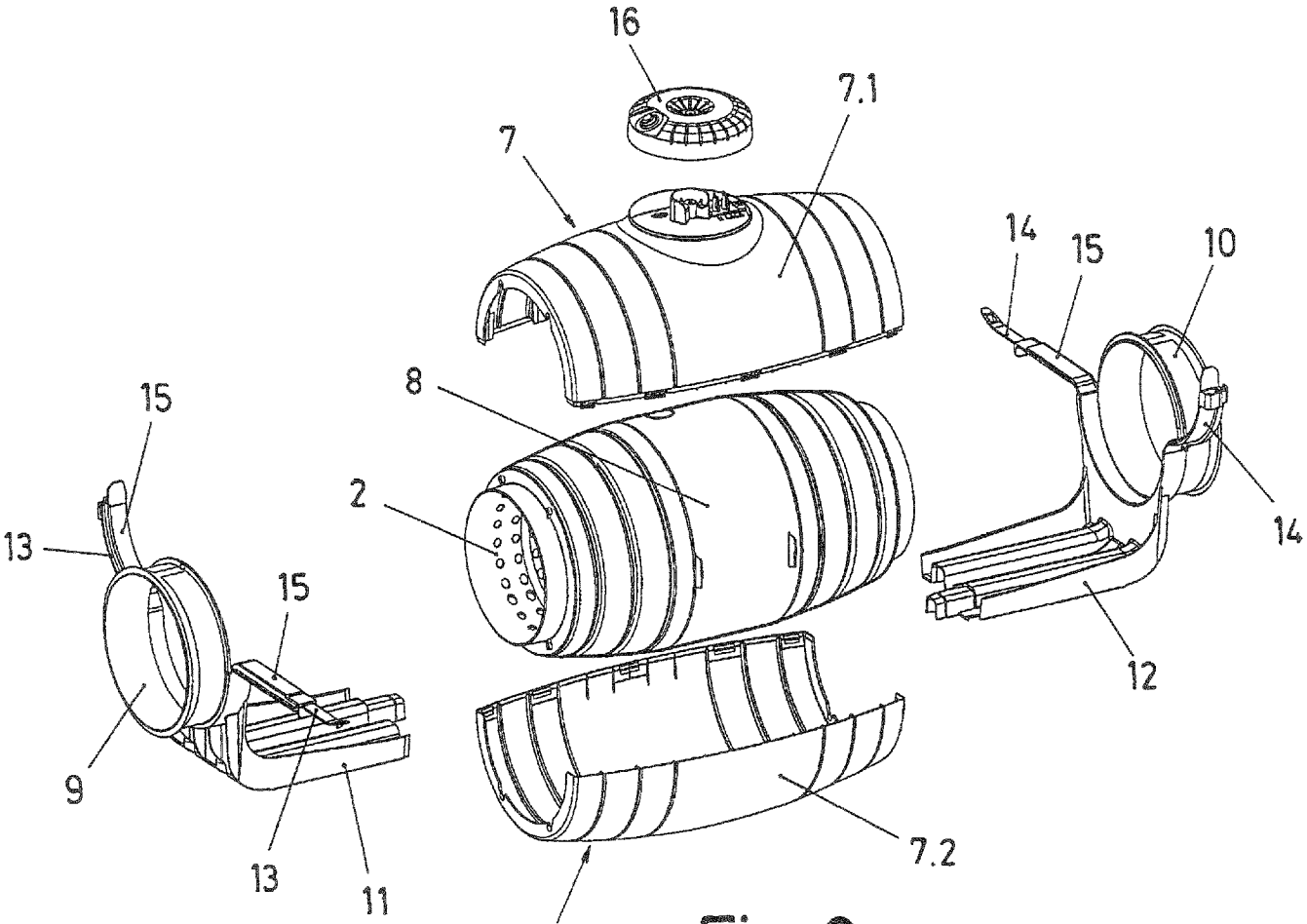
FIG. 3 shows a view of the assembly of the previous figure with the sound-absorbing blanket incorporated on the perforated casing.
Figure 4:
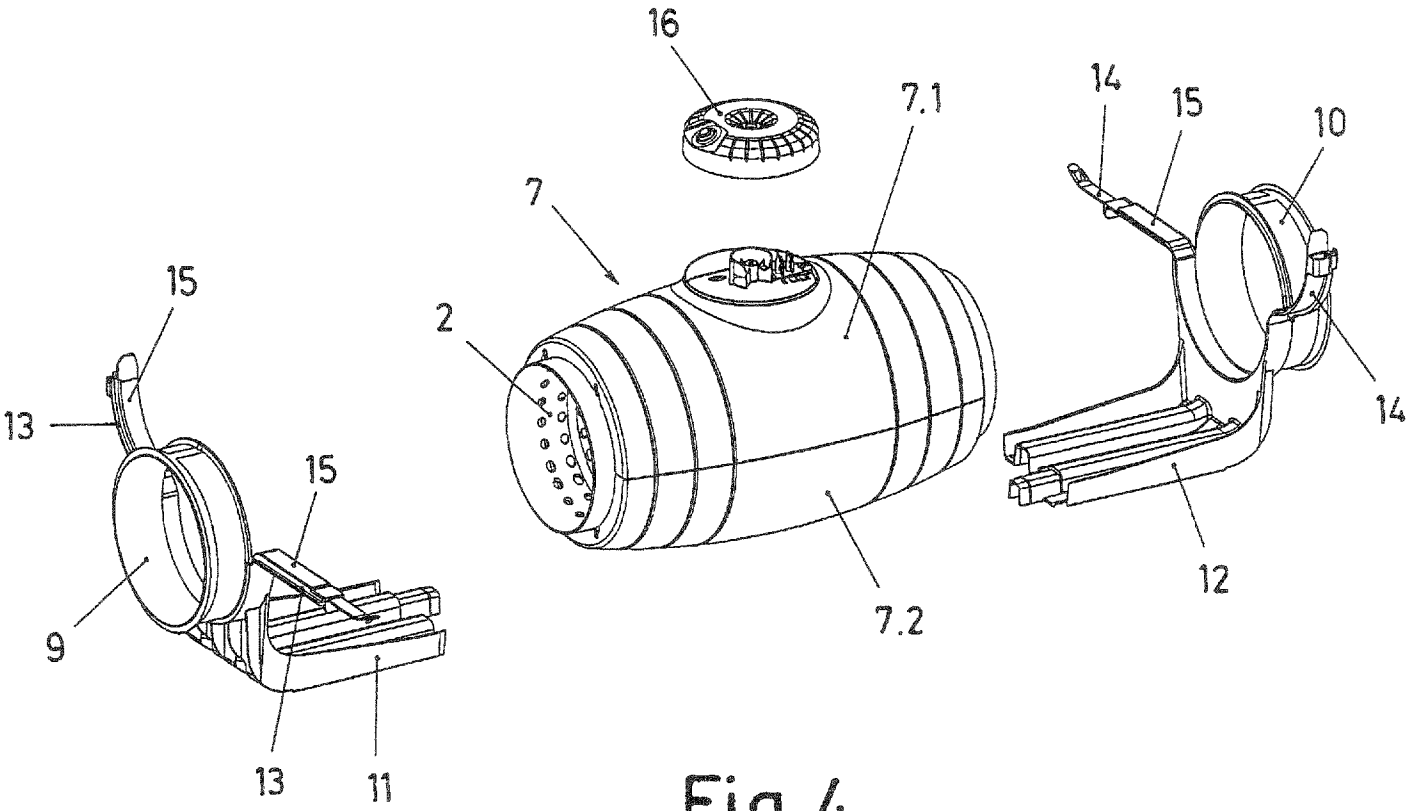
FIG. 4 shows a view of the assembly of the previous figure with the outer casing closed.
Figure 5:
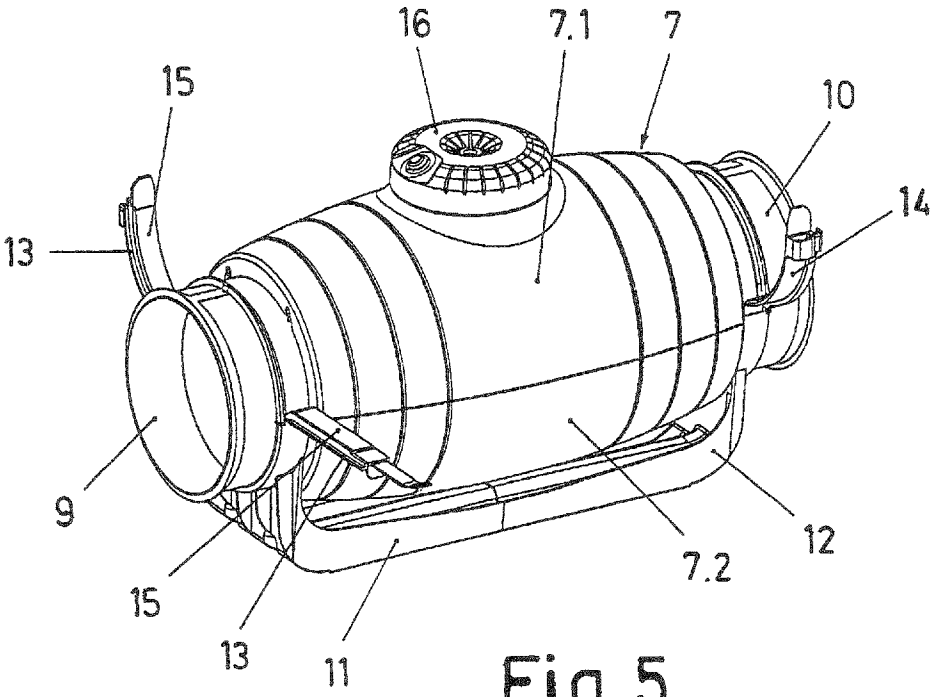
FIG. 5 shows a view of the assembly of the previous figure with the pieces coupled to one another.
Figure 6:
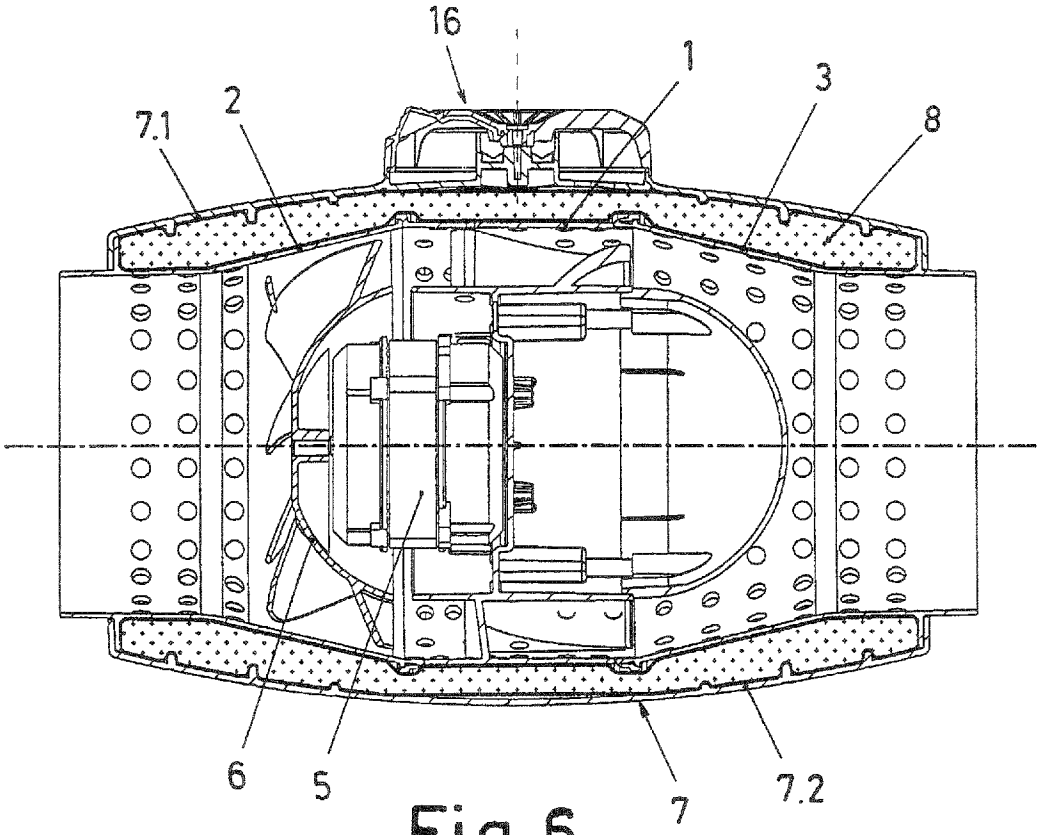
FIG. 6 shows a longitudinal section view of the fan assembly.
Figure 7:
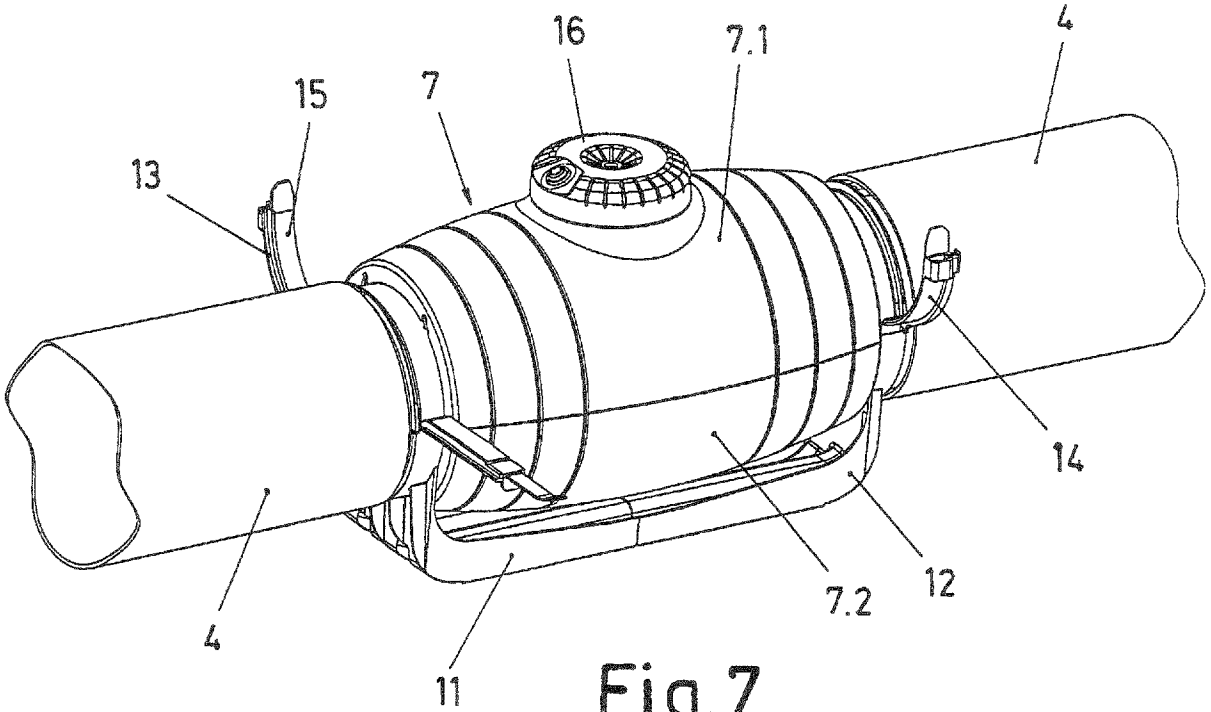
FIG. 7 shows a perspective view of the fan coupled with respect to air circulation pipes.

The object of the invention relates to a helicocentrifugal fan, with embodiment features which give it considerable sound-proofing efficacy.

The proposed fan is made up of an inner casing formed by a cylindrical central piece (1) and respective end pieces (2 and 3) which can be cylindrical, frustoconical or a combination of both shapes, said end pieces (2 and 3) determining at one end a mouth corresponding with the central piece (1) for the coupling thereon, whereas at the other end they determine a mouth corresponding with pieces (9 and 10) to which the air circulation pipes (4) to which the fan is to be coupled in its installation are coupled.

A motor (5) is arranged inside the central piece (1) of the aforementioned inner casing to which a helicocentrifugal propeller (6) protruding at one end of said central piece (1) is coupled.

Both that central piece (1) and the end pieces (2 and 3) making up the inner casing are perforated, with a singular distribution of holes which favors the attenuation of the noise produce by the motor (5) and the propeller (6) during the operation of the fan. The distribution of holes extends over the entire surface of the central piece (1) and of the end pieces (2 and 3) except in an area surrounding the propeller (6), where the holes would affect the air driving function.

An outer casing (7) is arranged around the assembly of the inner casing formed by the central piece (1) and the end pieces (2 and 3), said outer casing being formed by two complementary halves (7.1 and 7.2) which are coupled to one another, there being a chamber between this outer casing (7) and the inner casing, in which chamber a blanket (8) made of sound-absorbing material is arranged.

Pieces (9 and 10) are arranged in relation to the free ends of the end pieces (2 and 3) of the inner casing, which pieces (9 and 10) incorporate associated L-shaped formations (11 and 12) coupled therewith, said formations (11 and 12) determining a base for the fastening anchor of the fan in the installation site.

The pieces (9 and 10) further have flexible strips (13 and 14) integrated therewith by way of flanges which fasten said pieces (9 and 10) on the end pieces (2 and 3) of the inner casing, for which purpose the aforementioned flexible strips (13 and 14) are formed with an elastomeric material (15) in their inner part which favors the fastening.

The pieces (9 and 10) determine a cylindrical formation corresponding with the diameter of the pipes (4) to which the fan is to be coupled, such that the coupling with respect to said pipes (4) is established by introducing them on the aforementioned cylindrical formation of the pieces (9 and 10), that cylindrical formation being provided with a joint made of an elastomeric material to favor fastening effectiveness.

Said pieces (9 and 10) make the apparatus easy to uninstall for maintenance and cleaning because when releasing the flexible strips (13 and 14), the apparatus can be removed without having to move the coupling pipes (4), which are held in place by the pieces (9 and 10) which support them.

A terminal box (16) is arranged in one of the halves (7.1) of the outer casing (7) for connecting the electrical supply of the motor (5), said terminal box (16) being incorporated according to an assembly susceptible to rotation, which allows orienting the passage of electric connection cables in the appropriate direction.

In turn, the assembly making up the fan is susceptible to being incorporated in any angular position on the pieces (9 and 10) whereby the fastening anchor is established in the installation, such that with the combination of this positioning and the orientation of the terminal box (16), the fan can be arranged in the most appropriate position according to the available space and the direction of the electric cables in each installation site.

The invention claimed is:

1. A sound-proofed helicocentrifugal fan comprising:

a helicocentrifugal propeller;

a motor coupled to the helicocentrifugal propeller;

a first casing surrounding the helicocentrifugal propeller and the motor, the first casing having a central piece with a circular cross section and first and second end pieces coupled to the central piece, a surface of the first end piece, a surface of the second end piece, and a surface of the central piece are perforated with a distribution of holes except in an area surrounding the helicocentrifugal propeller;

first and second coupling pieces coupled respectively to the first and second end pieces and adapted to be coupled to respective air circulation pipes to which the fan is attached;

a blanket having a sound-absorbing material surrounding the first casing, the blanket having a circular cross section that encircles the first casing; and a second casing surrounding the blanket, the second casing having a circular cross section that encircles the blanket.

2. The sound-proofed helicocentrifugal fan according to claim 1, wherein each of the first and second end pieces has a first mouth corresponding to the central piece and a second mouth corresponding to a corresponding one of the first and second coupling pieces.

3. The sound-proofed helicocentrifugal fan according to claim 1, wherein each of the first and second coupling pieces has a flexible strip with an elastomeric material.

4. The sound-proofed helicocentrifugal fan according to claim 1, wherein each of the first and second coupling pieces has a cylindrical shape and a joint made of an elastomeric material, the joint having a diameter corresponding to a diameter of the air circulation pipes to which the fan is attached.

* * * * *